United States Patent [19]

Neal

[11] 4,386,886

[45] Jun. 7, 1983

[54] ADJUSTABLE VORTEX PUMP

[75] Inventor: Maynard J. Neal, North Tonawanda, N.Y.

[73] Assignee: Buffalo Forge Company, Buffalo, N.Y.

[21] Appl. No.: 361,620

[22] Filed: Mar. 25, 1982

Related U.S. Application Data

[62] Division of Ser. No. 140,161, Apr. 14, 1980, Pat. No. 4,338,062.

[51] Int. Cl.[3] ..... F04D 29/22

[52] U.S. Cl. ..... 415/213 A; 415/219 C; 415/DIG. 3; 415/131

[58] Field of Search ..... 415/DIG. 3, 213 A, 219 A, 415/219 C, 129, 131

[56] References Cited

U.S. PATENT DOCUMENTS

| | | | |
|---|---|---|---|
| 2,434,018 | 1/1948 | Stepanoff | 415/213 A X |
| 3,171,357 | 3/1965 | Egger | 415/213 A X |
| 3,188,966 | 6/1965 | Tetlow | 415/DIG. 3 X |
| 3,540,834 | 11/1970 | Allerton | 415/213 A X |
| 3,543,368 | 12/1970 | Marlow | 416/87 X |
| 3,759,628 | 9/1973 | Kempf | 415/213 A |
| 3,841,791 | 10/1974 | Doolin | 415/DIG. 3 |
| 3,844,680 | 10/1974 | Säterdal | 415/129 X |
| 3,918,829 | 11/1975 | Korzec | 415/213 A X |
| 4,139,330 | 2/1979 | Neal | 416/186 A |
| 4,338,062 | 7/1982 | Neal | 415/213 A |

FOREIGN PATENT DOCUMENTS

| | | | |
|---|---|---|---|
| 704304 | 2/1965 | Canada | 415/DIG. 3 |

*Primary Examiner*—Everette A. Powell, Jr.
*Attorney, Agent, or Firm*—Joseph P. Gastel

[57] ABSTRACT

A vortex pump which has been converted from a centrifugal pump by interposing an annular spacer between the power frame and casing of the centrifugal pump to provide space for a vortex impeller which has been substituted for the centrifugal impeller. An adjustable vortex impeller consisting of a hub portion with an annular flange having a plurality of sets of holes circumferentially spaced thereon, a plurality of vanes each having a plurality of holes in its root portion, and bolts for fastening each of the vanes in a plurality of different positions on the hub by passing through different pairs of aligned holes in the flange and in the roots to provide different impeller diameters while maintaining the discharge angle of the vanes within a small predetermined range. A plurality of sets of vanes of different sizes can be selectively mounted on the hub to further extend the range of impeller diameters.

2 Claims, 16 Drawing Figures

12
13
39
40
43
44
45
46
47
48
49
50
51
52
53
54
55
56
57
58
59
60
61
62
63
64
65
66
67

ADJUSTABLE VORTEX PUMP

This is a division, of application Ser. No. 140,161 filed on Apr. 14, 1980, now U.S. Pat. No. 4,338,062.

BACKGROUND OF THE INVENTION

The present invention relates to a vortex pump which is converted from a centrifugal pump; to an adjustable vortex pump; and to an adjustable impeller for a vortex pump.

By way of background, there are in existence centrifugal pumps which include a power frame and a casing containing a centrifugal impeller. Insofar as known, in the past such pumps were not converted to vortex type pumps, nor were the power frames and casings of centrifugal pumps utilized as parts of vortex pumps.

Insofar as known, prior vortex pumps usually mounted an impeller which was capable only of providing a particular discharge characteristic at a given speed. If a different discharge characteristic was desired from a particular pump, the speed of the pump had to be changed, thereby losing efficiency, or the impeller had to be replaced in its entirety.

Insofar as known, while centrifugal impellers of the type shown in U.S. Pat. No. 4,139,330 were adjustable by pivoting the vanes to different positions, it was not known to vary the characteristics of vortex type of impellers by repositioning each vane on a hub to provide different impeller diameters while limiting the range of the discharge angles of the vanes to a small predetermined value, nor was there any teaching in the prior art of selectively replacing vanes on a common hub with other vanes of a different size to vary the diameter of the impeller.

SUMMARY OF THE INVENTION

It is accordingly one object of the present invention to provide a vortex type pump which is fabricated by utilizing the power frame and casing of a centrifugal pump which have been joined by means of an annular spacer and which mounts a vortex type of impeller instead of a centrifugal impeller.

Another object of the present invention is to provide an improved vortex pump which includes an adjustable impeller which can provide different discharge diameters to thereby produce different discharge characteristics without changing revolving speed.

Yet another object of the present invention is to provide an adjustable vortex impeller in which the vanes can be mounted in different positions to provide different impeller diameters while maintaining the discharge angle within a predetermined small range.

Yet another object of the present invention is to provide an adjustable vortex impeller which is capable of mounting a plurality of different size vanes and is capable of providing a range of different impeller diameters for each size of vanes. Other objects and attendant advantages of the present invention will readily be perceived hereafter.

The present invention relates to a vortex pump comprising a power frame of a centrifugal pump, a casing of a centrifugal pump, shaft means mounted on said power frame, annular spacer means interposed between said power frame and said casing for providing space in said casing for receiving a vortex impeller, and a vortex impeller mounted on said shaft and located in operative relationship to said casing.

The present invention also relates to a vortex pump comprising a power frame, a casing attached to said power frame, and a vortex impeller in said casing, said vortex impeller comprising a hub portion and a plurality of vanes mounted thereon, and means for selectively mounting said vanes in different positions on said hub portion to thereby vary the diameter of said impeller while maintaining the discharge angle of the vane within a relatively small range.

The present invention also relates to an impeller for a vortex pump comprising a hub, a plurality of vanes, and means for mounting said vanes in circumferentially spaced relationship on said hub in a plurality of different positions which produce different impeller diameters while maintaining the discharge angle of said vanes within a relatively small predetermined range.

The various aspects of the present invention will be more fully understood when the following portions of the specification are read in conjunction with the accompanying drawings wherein:

DETAILED DESCRIPTION OF THE PREFERRED EMBODIMENTS

Figure 1:
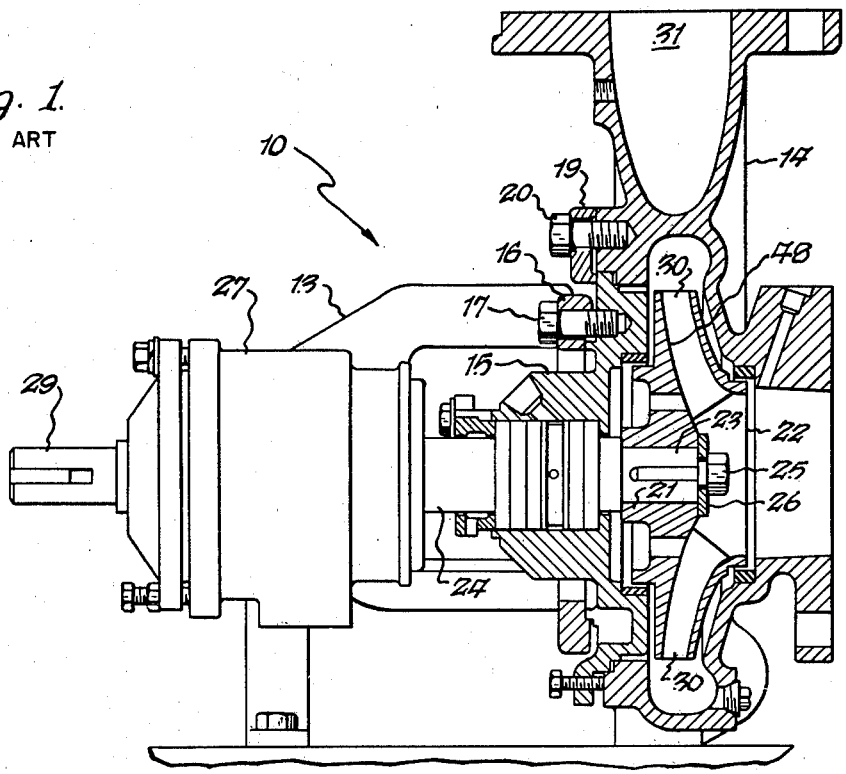
Fig. 1. PRIOR ART
FIG. 1 is a side elevational view, partially in cross section, of a prior art centrifugal pump.
Figure 2:
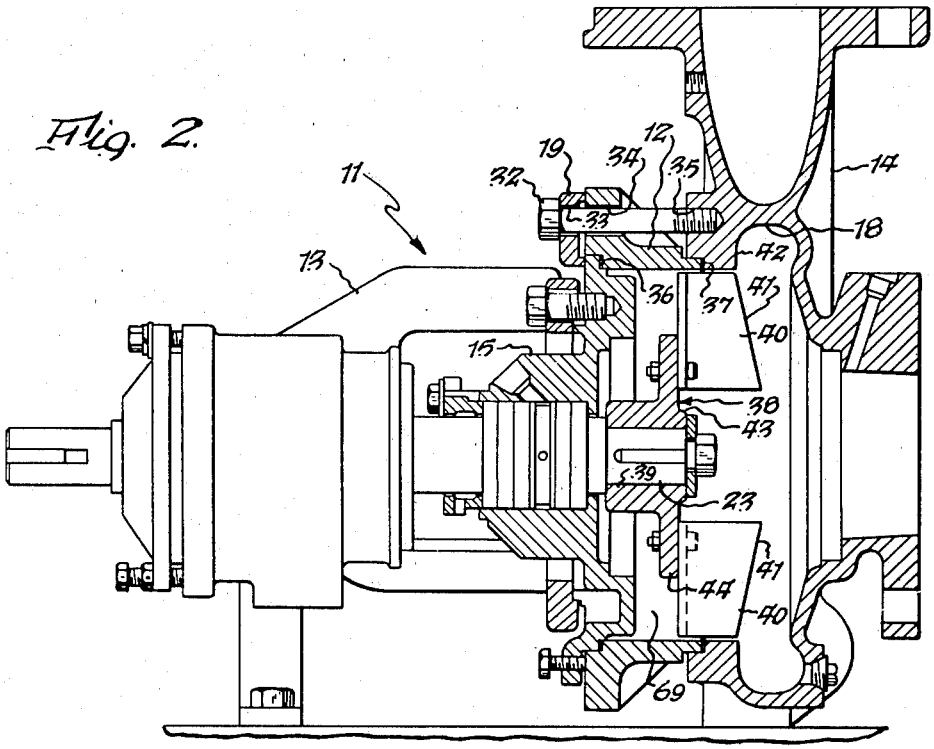
FIG. 2 is a side elevational view, partially in cross section, showing how the prior art centrifugal pump of FIG. 1 has been modified to mount a vortex type of impeller.

In accordance with one aspect of the present invention, the prior art type of centrifugal pump 10 of FIG. 1 is modified to be a vortex type of pump 11 of FIG. 2 by adding an annular spacer 12 between the power frame 13 and the casing 14, and by substituting a vortex impeller 38 for the centrifugal impeller 22.

In the prior art centrifugal pump 10, the casing cover 15 is secured to flange 16 of the power frame by a plurality of circumferentially spaced bolts 17. The casing 14 is secured to casing cover 15 by a plurality of circumferentially spaced clamping lugs 19 and bolts 20. The hub 21 of centrifugal impeller 22 is keyed to the end 23 of shaft 24 and secured thereon by means of screw 25 which bears on washer 26. The centrifugal pump 10 also includes suitable bearings within housing 27 which support other portions of shaft 24. The end 29 of shaft 24 protrudes from the power casing for receiving a pulley or a flexible coupling. It is to be noted that the outlet portions 30 of centrifugal impeller 22 are essentially in line with the outlet 31 of the casing 14. Since the centrifugal pump 10 of FIG. 1 is conventional in the art, it is deemed that further description is not necessary.

As noted briefly above, in order to modify the centrifugal pump 10 of FIG. 1 to be a vortex pump, an annular spacer 12 is interposed between casing cover 15 and casing 14. A plurality of circumferentially spaced bolts 32 extend through holes 33 in clamping lugs 19, through holes 34 in annular spacer 12 and are received in circumferentially spaced tapered bores 35 in casing 14. Suitable annular gaskets 36 and 37 are positioned as shown. By inserting annular spacer 12 as shown in FIG. 2, and by dimensioning central hub portion 39 of the impeller 38 to have an axial length, as shown, and by dimensioning impeller vanes 40 as shown, the leading edges 41 of impeller vanes 40 will be oriented relative to the rear side wall 42 of the volute 18 in casing 14, as shown in FIG. 2. Thus, the prior art centrifugal pump 10 of FIG. 1 may be converted to a vortex type of pump by the steps of removing the casing 14, removing centrifugal impeller 22 from the end 23 of the shaft, installing, annular spacer 12, mounting the central portion 43 of hub 39 of the vortex impeller 38 on the end 23 of the shaft, and remounting casing 14.

In accordance with another aspect of the present invention, the diameter of the vortex impeller 38 is selectively adjustable to cause the vortex pump to have different characteristics. Broadly, this adjustability is obtained by making provision on the hub 39 for mounting each of a plurality of vanes 40, 50 or 60 in a plurality of different positions on hub 39. Essentially this results in varying the diameter of the impeller as required. The pump is intended to operate at constant speed in all positions of the various vanes. Changing the impeller diameter to change the delivery of the pump, while operating the pump at a predetermined constant speed, causes the pump to operate at higher efficiencies than if the speed was varied to change the delivery while using a constant diameter impeller. This is because higher efficiencies are obtained by increasing the diameter to more nearly match the volute. Reducing the impeller diameter while maintaining higher speeds may also contribute to increased efficiency because the amount of axial bearing load and disc friction between the impeller and the pumped fluid is decreased at smaller diameters.

Figure 3:
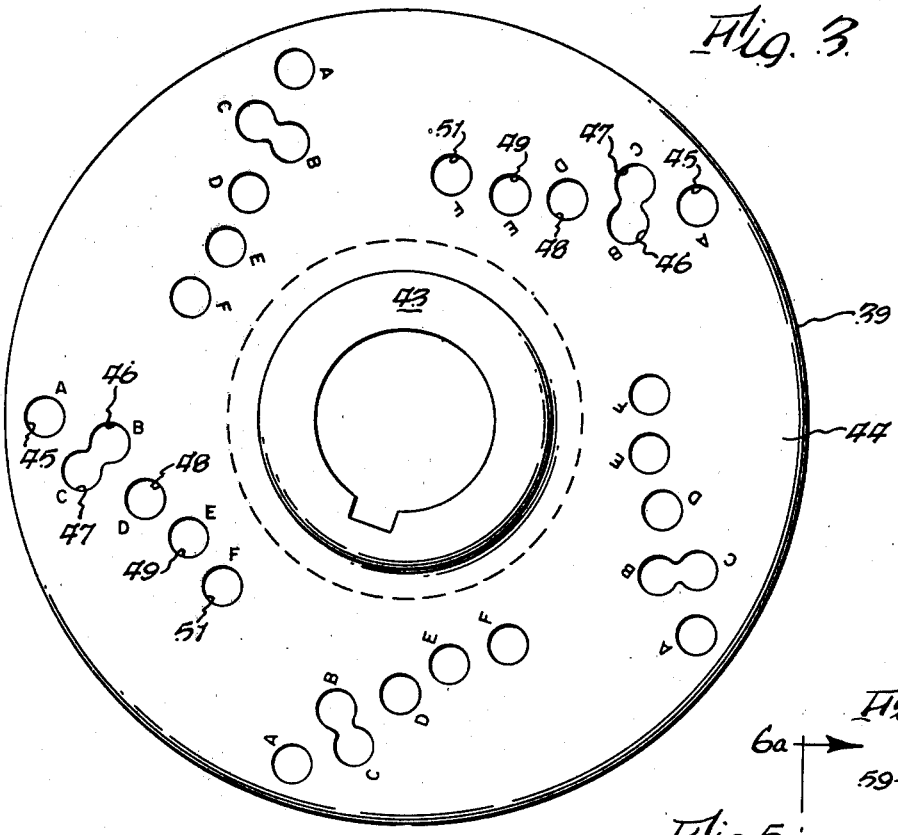
FIG. 3 is a plan view of the hub for the adjustable vortex type of impeller of the present invention.
Figure 6:
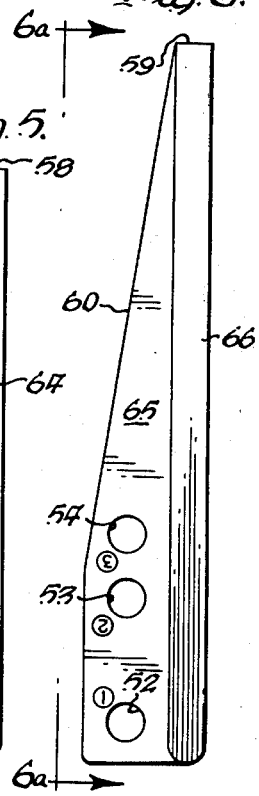
FIG. 6 is a plan view of a long vane which may be mounted on the hub of FIG. 3 in five different positions.
Figure 5:
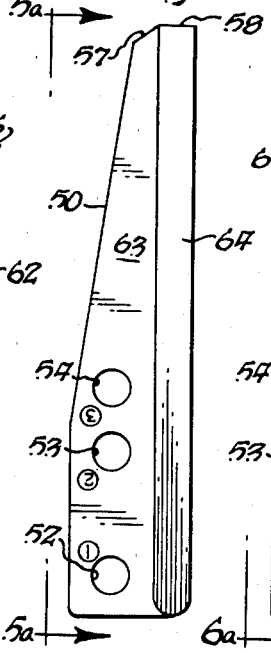
FIG. 5 is a plan view of a medium-sized vane which can be mounted on the hub of FIG. 3 in five different positions.
Figure 4:
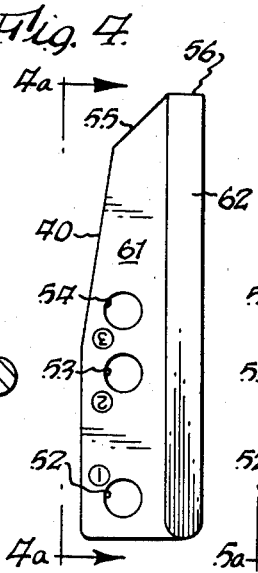
FIG. 4 is a plan view of a short vane which can be mounted on the hub of FIG. 3 in five different positions.
Figure 12:
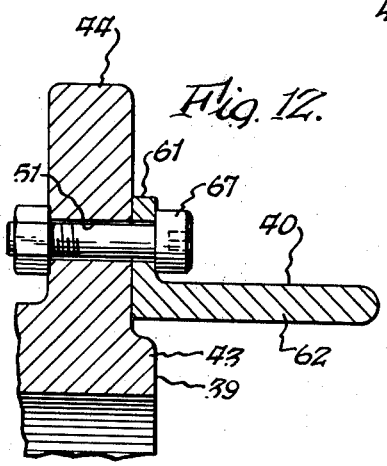
FIG. 12 is a fragmentary cross sectional view taken along line 12—12 of FIG. 7 and showing the vane in cross section and the manner in which it is attached to the hub.
Figure 4A:
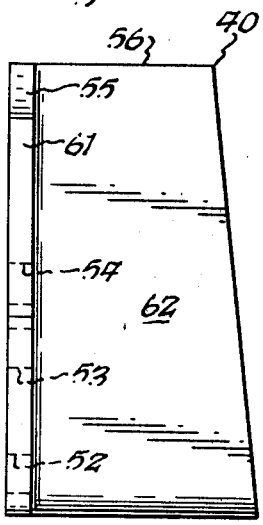
FIG. 4A is a side elevational view of the vane of FIG. 4.
Figure 5A:
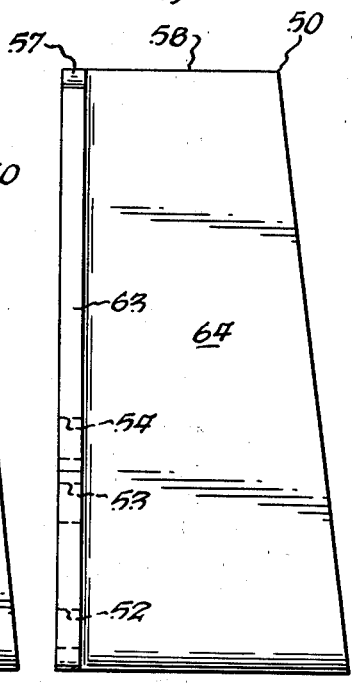
FIG. 5A is a side elevational view of the vane of FIG. 5.
Figure 6A:
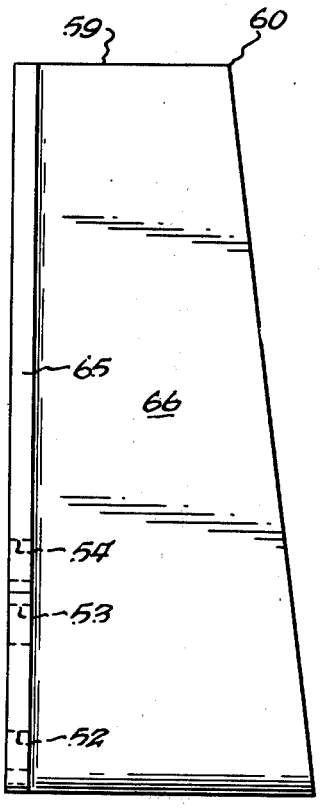
FIG. 6A is a side elevational view of the vane of FIG. 6.
Figure 13:
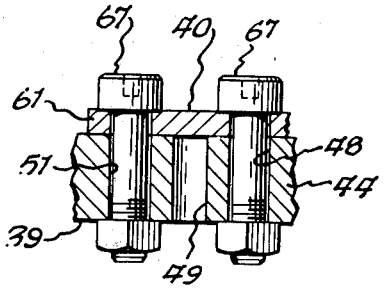
FIG. 13 is a fragmentary cross sectional view taken substantially along line 13—13 of FIG. 7 and showing the bolt type of attachment between the vane and the hub.

In order to change impeller diameters, hub 39 also includes an annular flange 44 having a plurality of circumferentially spaced sets of holes each consisting of holes 45, 46, 47, 48, 49 and 51 therein, which are denoted by letters A, B, C, D, E, F, respectively, marked on the flange 44, as shown in FIG. 3. Blades 40, 50 and 60 each have identical holes 52, 53 and 54 in their root portions, and these holes are marked on their root portions by numerals 1, 2 and 3, respectively, as shown. The outer end of vane 40 terminates at edges 55 and 56. Vane 50 differs from vane 40 in that it is longer than vane 40 and it terminates at edges 57 and 58. Vane 60 is longer than vane 50 and it terminates at edge 59.

As can be seen from the drawings, vane 40 has a root portion 61 and a blade portion 62; vane 50 has a root portion 63 and a blade portion 64; and vane 60 has a root portion 65 and a blade portion 66. The root portions of each of the vanes are attached to hub 39 by means of bolts 67 which pass through aligned holes in flange 44 and the root portions. It will be appreciated that other types of connecting members, such as rivets, pins, cap screws, or the like, may be used instead of bolts.

By aligning certain of the holes in the root of each vane with selected holes in the annular flange 44 and securing bolts 67 through such aligned holes, different diameters may be obtained as shown in the following table wherein each pair of aligned holes is shown in parenthesis:

| | HOLE COMBINATIONS | | |
|---|---|---|---|
| DIAMETER (INCHES) | VANE 40 | VANE 50 | VANE 60 |
| 7.0 | (F-1) (D-2) | | |
| 7.5 | (E-1) (B-2) | | |
| 8.0 | (E-1) (A-3) | | |
| 8.5 | (E-1) (C-2) | | |
| 9.0 | (D-1) (A-2) | (F-1) (D-2) | |
| 9.5 | | (E-1) (B-2) | |
| 10.0 | | (E-1) (A-3) | |
| 10.5 | | (E-1) (C-2) | |
| 11.0 | | (D-1) (A-2) | (F-1) (D-2) |
| 11.5 | | | (E-1) (B-2) |
| 12.0 | | | (E-1) (A-3) |
| 12.5 | | | (E-1) (C-2) |
| 13.0 | | | (D-1) (A-2) |

For example, to obtain a 7 inch diameter with vane 40, holes F and D of the hub are aligned with holes 1 and 2 of the vane, respectively, and bolts 67 are inserted therethrough. For obtaining an 8 inch diameter, holes E and A of the hub are aligned with holes 1 and 3, respectively, of the vane and bolts 67 are passed therethrough. Thus, it can be seen that vane 40 can provide an impeller diameters betwen 7 and 9 inches, inclusive, in ½ inch increments by the selection of the proper holes for alignment. Vane 50 can, in the same manner as specifically set forth in the above table, provide diameters between 9 and 11 inches, inclusive, in ½ inch increments. Vane 60 can provide diameters between 11 and 13 inches, inclusive, in ½ inch increments, by selective alignment of the holes in accordance with the above table. It is to be noted that there is an overlap at the 9 and 11 inch diameter size so that vane 50 or vane 40 can provide a 9 inch diameter, and there is also an overlap at the 11 inch size so that vanes 50 and 60 can provide the same diameter.

The various positions occupied by the bolts 67 in the various holes, are shown in FIGS. 7–11. Thus, in FIGS. 7, 8, 9, 10 and 11, the positions for the 7.0, 7.5, 8.0, 8.5 and 9.0 inch diameters, respectively, are shown for vane 40. In FIGS. 7, 8, 9, 10 and 11 the positions are shown of vane 50 for the 9.0, 9.5, 10.0, 10.5 and 11.0 inch diameters, respectively. In FIGS. 7, 8, 9, 10 and 11, the various positions are shown of vane 60 in the 11.0, 11.5, 12.0, 12.5 and 13.0 inch diameters, respectively.

Figures 7, 8, 9, 10, 11:
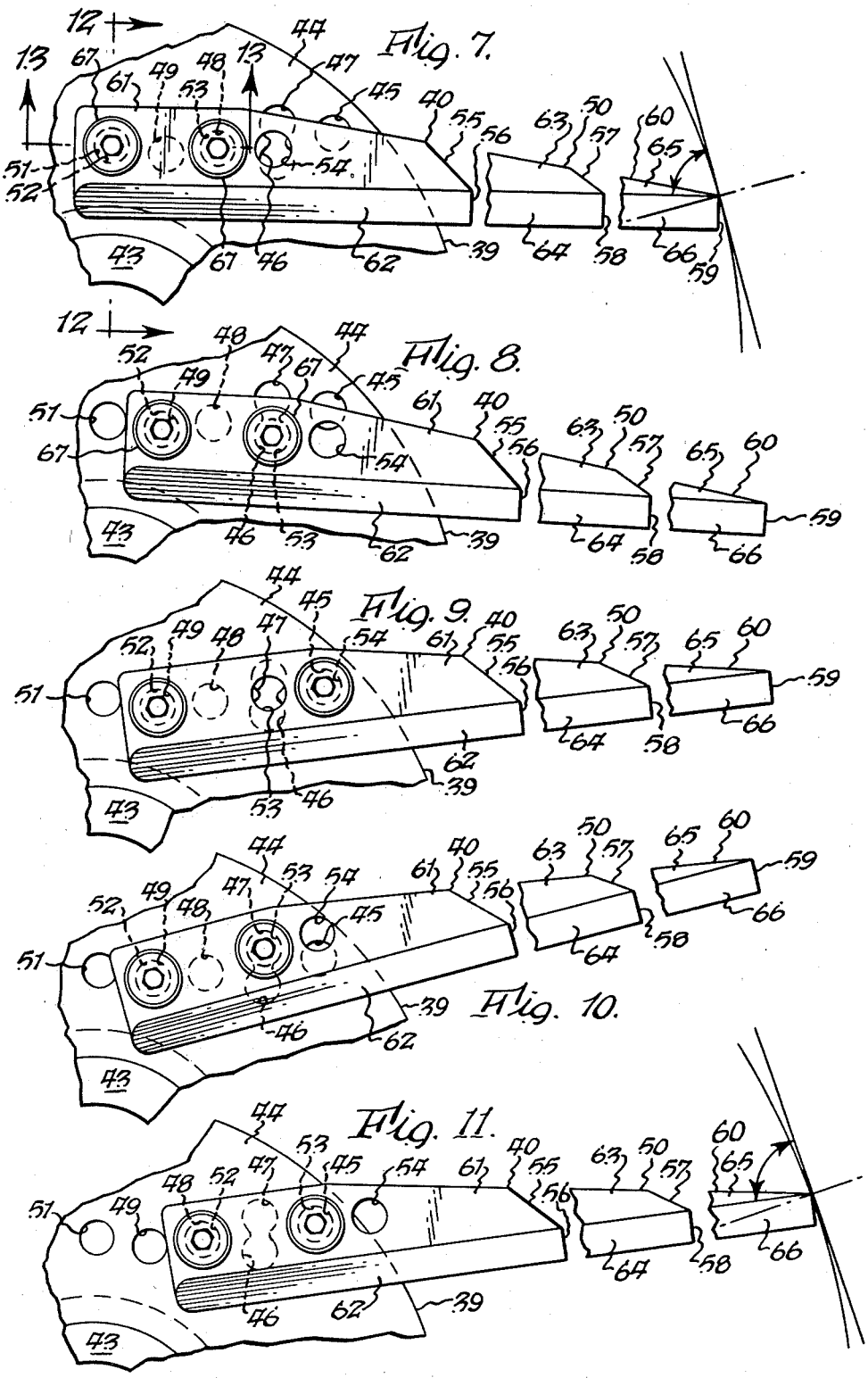
FIG. 7 is a fragmentary side elevational view showing the different impeller diameters which are obtainable when the impellers of FIGS. 4, 5 and 6 are mounted in a first position.
FIG. 8 is a view similar to FIG. 7 but showing the different impeller diameters which are obtainable when the vanes of FIGS. 4, 5 and 6 are mounted in a second position.
FIG. 9 is a view similar to FIG. 8 but showing the different impeller diameters which are obtainable when the vanes of FIGS. 4, 5 and 6 are mounted in a third position.
FIG. 10 is a view similar to FIG. 9 but showing the different impeller diameters which are obtainable when the vanes of FIGS. 4, 5 and 6 are mounted in a fourth position.
FIG. 11 is a view similar to FIG. 10 but showing the different impeller diameters which are obtainable when the vanes of FIGS. 4, 5 and 6 are mounted in a fifth position.

The discharge angle of vane 40 in its smallest diameter position is approximately 64° and the discharge angle of vane 60 at about its largest diameter position is approximately 78°. In the intermediate other positions of all of the vanes, the discharge angle is somewhere between 64° and 78°. The discharge angle is defined as the angle between the leading face of the vane blade and a tangent to a circle concentric with the hub at the intersection of the circle with the outer end of the leading face. This is shown in FIGS. 7 and 11. The following table shows the discharge angles for the three blades in their various positions:

| | DISCHARGE ANGLE IN DEGREES | | |
|---|---|---|---|
| DIAMETER (INCHES) | VANE 40 | VANE 50 | VANE 60 |
| 7.0 | 64.0 | | |
| 7.5 | 65.75 | | |
| 8.0 | 69.25 | | |
| 8.5 | 72.0 | | |
| 9.0 | 71.5 | 69.75 | |
| 9.5 | | 71.0 | |
| 10.0 | | 73.5 | |
| 10.5 | | 75.25 | |
| 11.0 | | 75.0 | 73.25 |
| 11.5 | | | 74.25 |
| 12.0 | | | 76.5 |
| 12.5 | | | 77.75 |
| 13.0 | | | 77.25 |

In a vortex impeller it is desirable to maintain a high discharge angle, as defined above, (but less than 90°) which produces an optimum head and a flatter performance curve, which means that there will be a higher discharge volume and higher pressure and greater efficiency over a greater range with smaller diameter impellers.

It can be seen from the above table that as the diameter for each vane decreases, the discharge angle is set generally at a lower value within the limited range. By this geometry, the range for each set of vanes is extended, that is, if the angle was not reduced, the diameter could not be extended to as small a value. In addition, lowering the discharge angle at smaller diameters extends the range of discharge pressures to lower values, thereby extending the total range of pressures for each vane.

It can be seen from the foregoing table that the discharge angle in all positions of vane 40 varies only about 8°; for vane 50 it varies only about 5°; and for vane 60 it varies only about 4°. Thus, for each vane the positions are such that the discharge angle is maintained within a small predetermined range. The same is true when all of the vanes are considered as a group, wherein the range is 14°.

At this point it is to be noted that the impeller depicted in FIG. 2 mounts vanes 40 which are located in the 9 inch position, that is, the maximum size position that it can occupy. Thus, with casing 14, the only range of sizes to which the impeller can be adjusted is between 7 inches and 9 inches in ½ inch increments. However, prior art pumps, such as shown in FIG. 1, are manufactured with three sizes of casings 14. These casings are the 9 inch, 11 inch and 13 inch casings. Therefore, if the pump originally had a 13 inch casing, it can accommodate an impeller with vanes 40, 50 or 60 mounted thereon to thus provide a full range of sizes between 7 inches and 13 inches in ½ inch increments. A casing, such as 14, having an 11 inch size can accommodate impellers having vanes 40 or 50 mounted thereon, to thereby provide a range of sizes between 7 inches and 11 inches in ½ inch increments. A casing having a 9 inch size, such as shown in FIG. 1, can accommodate an impeller mounting only vanes, such as 14, which provide a range of sizes between 7 inches and 9 inches in ½ inch increments.

From the foregoing description, it can be seen that various size pumps can be built up to specification from stock parts by the selection of the various size vanes. Furthermore, the size of the impeller can be changed in the field as required to provide different pump characteristics.

As can be seen from FIG. 2, and from FIGS. 7–11, there is a through space between the vanes to annular chamber 69. Therefore, this eliminates a considerable amount of the axial thrust on the impeller which would otherwise be present if a shroud 48, such as shown in FIG. 1, divided the inlet portion of the casing from the chamber behind the impeller. To further equalize the pressure in chamber 69, it can be seen from FIGS. 7–11 that at least a portion of one hole of each set of holes is unobstructed by the root of the vane so as to therefore further equalize the pressure. In addition to the foregoing, the geometry of the construction is such that there is very little variation in the vane angle which is occupied by all of the vanes in all of their positions. In addition to all the foregoing, the vanes and the hub are precision castings so that machining costs are minimized or eliminated.

At this point it is to be noted that the drawings are to scale.

While preferred embodiments of the present invention have been disclosed, it is to be understood that the present invention is not limited thereto by may be otherwise embodied within the scope of the following claims.

What is claimed is:

1. A vortex pump comprising a power frame of a centrifugal pump, a casing of a centrifugal pump, shaft means mounted on said power frame, annular spacer means interposed between said power frame and said casing for providing space in said casing for receiving a vortex impeller, and a vortex impeller mounted on said shaft and located in operative relationship to said casing.

2. A vortex pump as set forth in claim 1 including means for permitting selective disassembly of said casing from said annular spacer means, said impeller comprising a hub portion and a plurality of vanes, and means for selectively mounting said vanes in different positions on said hub to thereby vary the characteristics of said pump.

* * * * *